US010900096B2

(12) United States Patent
Takashima et al.

(10) Patent No.: US 10,900,096 B2
(45) **Date of Patent: *Jan. 26, 2021**

(54) STEEL SHEET AND PLATED STEEL SHEET, METHOD FOR PRODUCING HOT-ROLLED STEEL SHEET, METHOD FOR PRODUCING COLD-ROLLED FULL-HARD STEEL SHEET, METHOD FOR PRODUCING HEAT-TREATED SHEET, METHOD FOR PRODUCING STEEL SHEET, AND METHOD FOR PRODUCING PLATED STEEL SHEET

(71) Applicant: JFE Steel Corporation, Tokyo (JP)

(72) Inventors: Katsutoshi Takashima, Tokyo (JP); Chikaumi Sawanishi, Tokyo (JP); Yoshimasa Funakawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 197 days.

This patent is subject to a terminal disclaimer.

(21) Appl. No.: 16/087,931

(22) PCT Filed: Mar. 21, 2017

(86) PCT No.: PCT/JP2017/011077
§ 371 (c)(1),
(2) Date: Sep. 24, 2018

(87) PCT Pub. No.: WO2017/169940
PCT Pub. Date: Oct. 5, 2017

(65) Prior Publication Data

US 2019/0078173 A1 Mar. 14, 2019

(30) Foreign Application Priority Data

Mar. 31, 2016 (JP) ..... 2016-070739
Nov. 29, 2016 (JP) ..... 2016-231184

(51) Int. Cl.

| | |
|---|---|
| ***C22C 38/02*** | (2006.01) |
| ***C21D 8/02*** | (2006.01) |
| ***C21D 9/46*** | (2006.01) |
| ***C22C 38/14*** | (2006.01) |
| ***C22C 38/38*** | (2006.01) |
| ***C22C 38/16*** | (2006.01) |
| ***C22C 38/00*** | (2006.01) |
| ***C22C 38/08*** | (2006.01) |
| ***C22C 38/50*** | (2006.01) |
| ***C22C 38/48*** | (2006.01) |
| ***C21D 1/74*** | (2006.01) |
| ***C22C 38/04*** | (2006.01) |
| ***C22C 38/06*** | (2006.01) |
| ***C22C 38/12*** | (2006.01) |
| ***C23C 2/02*** | (2006.01) |

(Continued)

(52) U.S. Cl.
CPC ..... *C21D 8/0226* (2013.01); *C21D 1/74* (2013.01); *C21D 8/0236* (2013.01); *C21D 8/0263* (2013.01); *C21D 8/0273* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/38* (2013.01); *C22C 38/48* (2013.01); *C22C 38/50* (2013.01); *C23C 2/02* (2013.01); *C23C 2/06* (2013.01); *C23C 2/40* (2013.01); *C21D 2211/004* (2013.01); *C21D 2211/005* (2013.01); *C21D 2211/008* (2013.01); *C21D 2211/009* (2013.01)

(58) Field of Classification Search
CPC ..... C21D 8/0226; C21D 9/46; C22C 38/04; C22C 38/06; C22C 38/001; C22C 38/12; C22C 38/14; C22C 38/02
See application file for complete search history.

(56) References Cited

U.S. PATENT DOCUMENTS

2013/0032253 A1 2/2013 Kariya et al.
2014/0234655 A1* 8/2014 Takashima ..... C22C 38/06 428/659

(Continued)

FOREIGN PATENT DOCUMENTS

JP 3873638 B2 1/2007
JP 2011153361 A 8/2011

(Continued)

OTHER PUBLICATIONS

Mililitsky et al., "On Characteristics of DP600 Resistance Spot Welds", SAE 2003 World Congress—pp. 27-34.

(Continued)

*Primary Examiner* — Scott R Kastler
(74) *Attorney, Agent, or Firm* — RatnerPrestia

(57) ABSTRACT

Provided herein is a steel sheet of a specific composition that has a micro structure containing, by volume, 75 to 95% of ferrite, 3 to 15% of martensite, 0.5 to 10% of perlite, 10% or less of unrecrystallized ferrite, and 21.5% or less of a low-temperature occurring phase representing the remainder, and in which the ferrite has an average crystal grain diameter of 6 μm or less, and the martensite has an average crystal grain diameter of 3 μm or less, and an average aspect ratio of 4.0 or less, and in which a Nb base precipitate having an average grain diameter of 0.10 μm or less is contained. The steel sheet has a tensile strength of 590 MPa or more.

24 Claims, No Drawings

(51) Int. Cl.
*C23C 2/06* (2006.01)
*C23C 2/40* (2006.01)

(56) References Cited

U.S. PATENT DOCUMENTS

| | | | | |
|---|---|---|---|---|
| 2015/0017472 | A1* | 1/2015 | Kimura | C21D 8/0273 428/659 |
| 2015/0322552 | A1 | 11/2015 | Takashima et al. | |
| 2019/0078173 | A1* | 3/2019 | Takashima | C22C 38/12 |
| 2019/0085421 | A1* | 3/2019 | Takashima | C22C 38/58 |
| 2019/0085427 | A1* | 3/2019 | Takashima | C21D 6/004 |

FOREIGN PATENT DOCUMENTS

| | | | |
|---|---|---|---|
| JP | 2011225955 | A | 11/2011 |
| WO | 2004104254 | A | 12/2004 |
| WO | 2014097559 | A1 | 6/2014 |

OTHER PUBLICATIONS

International Search Report and Written Opinion for International Application No. PCT/JP2017/011077, dated Jun. 27, 2017—5 pages.
Non Final Office Action for U.S. Appl. No. 16/089,096, dated Jun. 29, 2020, 8 pages.

* cited by examiner

STEEL SHEET AND PLATED STEEL SHEET, METHOD FOR PRODUCING HOT-ROLLED STEEL SHEET, METHOD FOR PRODUCING COLD-ROLLED FULL-HARD STEEL SHEET, METHOD FOR PRODUCING HEAT-TREATED SHEET, METHOD FOR PRODUCING STEEL SHEET, AND METHOD FOR PRODUCING PLATED STEEL SHEET

CROSS REFERENCE TO RELATED APPLICATIONS

This is the U.S. National Phase application of PCT/JP2017/011077, filed Mar. 21, 2017, which claims priority to Japanese Patent Application No. 2016-070739, filed Mar. 31, 2016, and Japanese Patent Application No. 2016-231184, filed Nov. 29, 2016 the disclosures of each of these applications being incorporated herein by reference in their entireties for all purposes.

FIELD OF THE INVENTION

The present invention relates to a steel sheet and a plated steel sheet, and to a method for producing a hot-rolled steel sheet, a method for producing a cold-rolled full-hard steel sheet, a method for producing a heat-treated sheet, a method for producing a steel sheet, and a method for producing a plated steel sheet.

BACKGROUND OF THE INVENTION

Today's increasing environmental awareness has created stricter regulations on 002 emissions, and the automobile industry faces the challenge of making lighter vehicles for improved fuel consumption. To this end, high-strength steel sheets are used to make thinner automobile components, and steel sheets having a tensile strength (TS) of 590 MPa or more have been used for this purpose. High-strength steel sheets used for structural and reinforcing members of automobiles are galvanized to prevent rusting. Steel sheets are also required to satisfy desirable mechanical properties, including stretch flangeability (hole expansion formability) and ductility (elongation). Particularly, a steel sheet used to form a component of a complex shape is required to satisfy both of these properties—elongation and hole expansion formability—at the same time, in addition to individually satisfying desirable elongation and hole expansion formability. Such steel sheets are also required to absorb large collision energy. The property to absorb collision energy can be effectively improved by increasing the yield ratio. With a high yield ratio, collision energy can be efficiently absorbed even with a small amount of deformation. Here, yield ratio (YR) is the ratio of yield stress (YS) to TS, and is represented by YR (%)=YS/TS×100(%).

For example, PTL 1 discloses a method for producing a hot-dip galvanized steel sheet having a tensile strength of 590 MPa or more provided by precipitation strengthening with addition of niobium.

High-strength hot-dip galvanized steel sheets used for structural and reinforcing members of automobiles are typically assembled by spot welding after press working. Here, an attempt to attain a nugget size with an input of high heat high enough to cause splash fails as it causes cracking in the steel sheet as a result of melting of copper and zinc at the interface between an electrode and the steel sheet (for example, NPL 1). When such surface cracking is present, there is a high probability of stress concentrating at the cracks upon collision of an automobile, and the absorbed collision energy will be smaller even when the steel sheet has the property to absorb a large collision energy with a high yield ratio.

PATENT LITERATURE

PTL 1: Japanese Patent No. 3873638

Non Patent Literature

NPL 1: M. Militisky, E. Pakalnins, C. Jiang and A. K. Thompson: Proc. on SAE 2003 World Congress, (2003) p. 244

SUMMARY OF THE INVENTION

However, the technique described in PTL 1 is insufficient in terms of ductility, and cannot provide the required workability in applications such as in structural and reinforcing members.

Indeed, no technique is available with regard to a plated steel sheet that can reduce surface cracking at the time of spot welding while having a high yield ratio.

It is accordingly an object of the present invention to provide a solution to the problems of the related art, and the invention is intended to provide a high-yield-ratio and high-strength plated steel sheet having excellent elongation, excellent hole expansion formability, and excellent spot weldability, and a method for producing such a plated steel sheet. The present invention is also intended to provide a steel sheet needed to obtain the plated steel sheet, a method for producing a hot-rolled steel sheet needed to obtain the plated steel sheet, a method for producing a cold-rolled full-hard steel sheet needed to obtain the plated steel sheet, a method for producing a heat-treated sheet needed to obtain the plated steel sheet, and a method for producing a steel sheet needed to obtain the plated steel sheet.

The present inventors conducted intensive studies, and found that, in order to improve elongation, hole expansion formability, and spot weldability while maintaining a high yield ratio, it is required to control the volume fractions of different phases of a micro structure, and to finely disperse ferrite and martensite, and disperse fine precipitates. The invention is based on these findings.

With regard to surface cracking (spot weldability) at the time of spot welding, an attempt to attain a large nugget size with a current value high enough to cause splash results in a tensile stress being applied to the heat affected zone (HAZ) of a plated steel sheet surface held with electrodes. Here, the copper in the electrodes melts and liquefies when the weld time is long. In the case of a plated steel sheet, the zinc at the steel sheet surface melts, and the liquefied copper and zinc diffuse into the steel sheet under concentrated tensile stress. This causes embrittlement due to the liquid metals, and cracking occurs. After further studies, the present inventors found that crack generation can be reduced when toughness is improved by refining the micro structure, including the HAZ at the steel sheet surface. The yield ratio decreases when martensite is present in a micro structure. It was found that production of fine ferrite grains and spherical martensite is possible when the volume fraction, the aspect ratio, and the average crystal grain diameter of martensite are controlled while also controlling the average grain diameter of Nb base precipitates (carbides, nitrides, and carbonitrides of niobium), and that this improves spot weldability while also improving elongation and hole expansion formability with maintained high strength, without lowering the yield ratio. To this end, niobium is added, and the cooling conditions of hot rolling are controlled to form Nb base precipitates having an average grain diameter of 0.10 μm or less after annealing. It was found that these precipitates inhibit nuclear growth in the recrystallization process during annealing, and nucleation preferentially takes place to make the crystal grain diameters of ferrite and martensite smaller.

Specifically, exemplary embodiments of the present invention provide the following.

[1] A steel sheet of a composition comprising, in mass %, C: 0.05 to 0.11%, Si: 0.60% or less, Mn: 1.50 to 2.10%, P: 0.05% or less, S: 0.005% or less, Al: 0.01 to 0.10%, N: 0.010% or less, Ti: 0.005 to 0.07%, Nb: 0.01 to 0.10%, and the balance Fe and unavoidable impurities, and of a micro structure that contains 75 to 95% of ferrite, 3 to 15% of martensite, 0.5 to 10% of perlite, and 10% or less of unrecrystallized ferrite by volume, and a low-temperature occurring phase representing the remainder, and in which the ferrite has an average crystal grain diameter of 6 μm or less, and the martensite has an average crystal grain diameter of 3 μm or less, and an average aspect ratio of 4.0 or less, and in which a Nb base precipitate having an average grain diameter of 0.10 μm or less is contained, the steel sheet having a tensile strength of 590 MPa or more.

[2] The steel sheet according to item [1], wherein the composition further comprises V: 0.10% or less in mass %.

[3] The steel sheet according to item [1] or [2], wherein the composition further comprises, in mass %, one or more selected from Cr: 0.50% or less, Mo: 0.50% or less, Cu: 0.50% or less, Ni: 0.50% or less, B: 0.01% or less, and a total of 0.005% or less of Ca and/or REM.

[4] A plated steel sheet comprising a plating layer on a surface of the steel sheet of any one of items [1] to [3].

[5] The plated steel sheet according to item [4], wherein the plating layer is a hot-dip galvanized layer or a hot-dip galvannealed layer.

[6] A method for producing a hot-rolled steel sheet, the method comprising:

hot rolling a steel material of the composition of any one of items [1] to [3] under the conditions where a rolling reduction of a final pass of finish rolling is 12% or more, a rolling reduction of a preceding pass of the final pass is 15% or more, and a finisher delivery temperature is 850 to 950° C.;

subjecting the steel after the hot rolling to primary cooling in which the steel is cooled to a cooling stop temperature at a first average cooling rate of 75° C./s or more, the cooling stop temperature being 700° C. or less;

subjecting the steel after the primary cooling to secondary cooling in which the steel is cooled to a coiling temperature at a second average cooling rate of 5° C./s or more and less than 75° C./s; and coiling the steel at a coiling temperature of 450 to 650° C.

[7] A method for producing a cold-rolled full-hard steel sheet, the method comprising pickling and cold rolling the hot-rolled steel sheet obtained by the method of item [6].

[8] A method for producing a steel sheet, comprising:

heating the cold-rolled full-hard steel sheet obtained by the method of item [7], the cold-rolled full-hard steel sheet being heated under the conditions where the dew point in a temperature range of 600° C. or more is −40° C. or less, and a maximum achieving temperature is 730 to 900° C.;

retaining the heated cold-rolled full-hard steel sheet at the maximum achieving temperature for 15 to 600 seconds; and cooling the retained cold-rolled full-hard steel sheet to a cooling stop temperature at an average cooling rate of 3 to 30° C./s, the cooling stop temperature being 600° C. or less.

[9] A method for producing a heat-treated sheet, comprising:

heating the cold-rolled full-hard steel sheet obtained by the method of item [7], the cold-rolled full-hard steel sheet being heated at a heating temperature of 700 to 900° C.; and cooling the cold-rolled full-hard steel sheet.

[10] A method for producing a steel sheet, comprising:

heating the heat-treated sheet obtained by the method of item [9], the heat-treated sheet being heated under the conditions where the dew point in a temperature range of 600° C. or more is −40° C. or less, and a maximum achieving temperature is 730 to 900° C.;

retaining the heat-treated sheet at the maximum achieving temperature for 15 to 600 seconds; and cooling the retained heat-treated sheet to a cooling stop temperature at an average cooling rate of 3 to 30° C./s, the cooling stop temperature being 600° C. or less.

[11] A method for producing a plated steel sheet, the method comprising plating a surface of the steel sheet obtained by the method of item [8] or [10].

[12] The method according to item [11], wherein the plating is a process that involves hot-dip galvanization, and alloying at 450 to 600° C.

A plated steel sheet provided by embodiments of the present invention has high yield ratio, high tensile strength, and high elongation, along with excellent hole expansion formability, and excellent spot weldability. Specifically, "high yield ratio" means a yield ratio of 70% or more, "high tensile strength" means a tensile strength of 590 MPa or more, "high elongation" means an elongation of 28% or more, "excellent hole expansion formability" means a hole expansion rate of 60% or more, and "excellent spot weldability" means that surface cracking does not occur in spot welding under a current value that is 0.1 kA smaller than the current value that causes splash. From the viewpoint of workability and other properties, the tensile strength is preferably less than 780 MPa, more preferably 700 MPa or less.

The steel sheet, the method for producing a hot-rolled steel sheet, the method for producing a cold-rolled full-hard steel sheet, the method for producing a heat-treated sheet, and the method for producing a steel sheet of the present invention can be used as an intermediate product for obtaining the plated steel sheet of desirable properties above, or as methods for producing such an intermediate product, and contribute to improving the properties of a plated steel sheet.

DETAILED DESCRIPTION OF EMBODIMENTS OF THE INVENTION

An embodiment of the present invention is described below. The present invention, however, is not limited to the following embodiment.

The present invention represents a steel sheet and a plated steel sheet, and a method for producing a hot-rolled steel sheet, a method for producing a cold-rolled full-hard steel sheet, a method for producing a heat-treated sheet, a method for producing a steel sheet, and a method for producing a plated steel sheet. The following first describes how these are related to one another.

A steel sheet of the present invention is an intermediate product for obtaining a plated steel sheet of the present invention. In the case of a single method, a starting steel material such as a slab is formed into a plated steel sheet through a manufacturing process that produces a hot-rolled steel sheet, a cold-rolled full-hard steel sheet, and a steel sheet in succession. In the case of a double method, a starting steel material such as a slab is formed into a plated steel sheet through a manufacturing process that produces a hot-rolled steel sheet, a cold-rolled full-hard steel sheet, a heat-treated sheet, and a steel sheet in succession. The steel sheet of the present invention is a steel sheet produced in these processes.

The method for producing a hot-rolled steel sheet of the present invention is a method that produces the hot-rolled steel sheet in the foregoing process.

The method for producing a cold-rolled full-hard steel sheet of the present invention is a method that produces a cold-rolled full-hard steel sheet from the hot-rolled steel sheet in the foregoing process.

In the case of the double method, the method for producing a heat-treated sheet of the present invention is a method that produces a heat-treated sheet from the cold-rolled full-hard steel sheet in the foregoing process.

In the case of the single method, the method for producing a steel sheet of the present invention is a method that produces a steel sheet from the cold-rolled full-hard steel sheet in the foregoing process. In the case of the double method, the method for producing a steel sheet of the present invention is a method that produces a steel sheet from the heat-treated sheet in the foregoing process.

The method for producing a plated steel sheet of the present invention is a method that produces a plated steel sheet from the steel sheet in the foregoing process.

Because of these relationships, the hot-rolled steel sheet, the cold-rolled full-hard steel sheet, the heat-treated sheet, the steel sheet, and the plated steel sheet share the same composition, and the steel sheet and the plated steel sheet share the same micro structure. The following describes these common characteristics first, and the steel sheet, the plated steel sheet, and the producing methods will be described later.

Composition

The steel sheets according to the embodiments of the present invention, including the plated steel sheet, have a composition containing, in mass %, C: 0.05 to 0.11%, Si: 0.60% or less, Mn: 1.50 to 2.10%, P: 0.05% or less, S: 0.005% or less, Al: 0.01 to 0.10%, N: 0.010% or less, Ti: 0.005 to 0.07%, Nb: 0.01 to 0.10%, and the balance Fe and unavoidable impurities.

The composition may further contain V: 0.10% or less in mass %.

The composition may further contain, in mass %, one or more selected from Cr: 0.50% or less, Mo: 0.50% or less, Cu: 0.50% or less, Ni: 0.50% or less, B: 0.01% or less, and a total of 0.005% or less of Ca and/or REM.

The components are described below. In the following, "%" representing the content of the component means percent by mass.

C: 0.05 to 0.11%

Carbon is an element that is effective at enhancing the strength of the steel sheet, and contributes to forming martensite and perlite in an embodiment of the present invention. With a C content of less than 0.05%, it is difficult to provide the necessary volume fraction for martensite. The preferred C content is 0.06% or more. When carbon is added in excess of 0.11%, the hardness difference between ferrite and martensite increases, and the hole expansion formability decreases. Such an excess carbon content also impairs the toughness in HAZ at the time of spot welding, and surface cracking occurs during spot welding. The preferred C content is 0.10% or less.

Si: 0.60% or Less

Silicon adds strength to ferrite through solid solution strengthening. Because of this effect, the hardness difference from the hard phase becomes smaller in the presence of silicon, and the hole expansion rate tends to increase. However, when contained in large amounts, silicon concentrates at the steel sheet surface in the form of an oxide during annealing, and the plateability deteriorates. An excess silicon content also impairs toughness at high temperature, and often causes surface cracking at the time of spot welding. For this reason, the Si content is 0.60% or less. The Si content may be less than 0.60%. The Si content is preferably 0.50% or less, more preferably less than 0.50%, further preferably 0.45% or less, most preferably 0.30% or less. These is no lower limit; however, the Si content is preferably 0.005% or more from the viewpoint of hole expansion rate. The lower limit is not particularly limited because the hole expansion rate can improve even with a Si content of less than 0.005%.

Mn: 1.50 to 2.10%

Manganese is useful for solid solution strengthening, and for the formation of a second phase (a phase other than ferrite) such as martensite, and contributes to enhancing strength. To this end, a Mn content of 1.50% or more is needed. When contained in excess, manganese lowers the transformation point of martensite (Ms point) in HAZ at the time of spot welding. This increases the hardness of HAZ, and surface cracking becomes likely to occur at the time of spot welding. For this reason, the Mn content is 2.10% or less. The Mn content is preferably 2.00% or less.

P: 0.05% or Less

Phosphorus contributes to enhancing strength through solid solution strengthening. Phosphorus also enables control of an alloying rate when alloying a hot-dip galvanized steel sheet, and the plateability can be improved by adjusting the P content. The preferred P content for this effect is 0.001% or more. However, when contained in excess, phosphorus segregates at grain boundaries at the time of spot welding, and promotes surface cracking during spot welding. For this reason, the P content is 0.05% or less. The P content is preferably 0.04% or less.

S: 0.005% or Less

With a high sulfur content, sulfur produces large amounts of sulfides such as MnS. MnS becomes an initiation point of voids, and voids occur at the time of punching. This impairs hole expansion formability. For this reason, the upper limit of S content is 0.005%. The S content is preferably 0.004% or less. The lower limit of S content is not particularly limited. However, an excessively small S content increases the steel production cost, and the S content is preferably 0.0003% or more.

Al: 0.01 to 0.10%

Aluminum is an element that is needed for deoxidation, and needs to be contained in an amount of 0.01% or more to obtain this effect. The Al content is 0.10% or less because the effect becomes saturated with an Al content of more than 0.10%. The preferred Al content is 0.05% or less.

N: 0.010% or Less

Nitrogen needs to be contained in a reduced amount because this element forms coarse nitrides with titanium and niobium, and impairs the hole expansion formability. The N content is 0.010% or less because this tendency becomes more pronounced with a N content of more than 0.010%.

The N content is preferably 0.008% or less. In view of steel production cost, the lower limit of N content is preferably 0.0005% or more.

Ti: 0.005 to 0.07%

Titanium has the effect to inhibit nuclear growth during annealing by forming fine Ti base precipitates (carbides, nitrides, and carbonitrides of titanium; at least one of carbides, nitrides, and carbonitrides precipitate). Because of this effect, titanium contributes to making a fine micro structure, and increasing strength. In order to obtain this effect, titanium is contained in an amount of 0.005% or more. The preferred Ti content is 0.010% or more. When titanium is contained in large amounts, excess generation of unrecrystallized ferrite occurs, and the elongation seriously decreases. For this reason, the Ti content is 0.07% or less. The Ti content is preferably 0.04% or less. In the context of the composition and the micro structure according to embodiments of the present invention, the average grain diameter of Ti base precipitates is typically 0.01 to 0.10 μm.

Nb: 0.01 to 0.10%

As with the case of titanium, niobium contributes to making a fine micro structure by forming fine precipitates (carbides, nitrides, and carbonitrides of niobium; at least one of carbides, nitrides, and carbonitrides precipitate). In order to obtain this effect, niobium is contained in an amount of 0.01% or more. The preferred Nb content is 0.015% or more. The elongation seriously decreases when niobium is contained in large amounts. For this reason, the Nb content is 0.10% or less. The Nb content is preferably 0.06% or less.

In the present invention, at least one of the following components may be contained, in addition to the components above.

V: 0.10% or Less

As with the case of titanium, vanadium contributes to making a fine micro structure by forming fine precipitates, and may be added as required. From the viewpoint of obtaining this effect, the V content is preferably 0.01% or more. However, the elongation seriously decreases when vanadium is contained in large amounts. For this reason, the V content is preferably 0.10% or less.

Cr: 0.50% or Less

Chromium is an element that contributes to enhancing strength by generating martensite, and may be added as required. From the viewpoint of obtaining this effect, the Cr content is preferably 0.01% or more. However, a Cr content of more than 0.50% generates martensite in excess, and a chromium oxide occurs on the steel sheet surface during annealing. This impairs plateability, and often causes non-uniform plating. For this reason, the Cr content is preferably 0.50% or less.

Mo: 0.50% or Less

As with the case of chromium, molybdenum is an element that contributes to enhancing strength by generating martensite, and, in part, carbides. From the viewpoint of obtaining this effect, the Mo content is preferably 0.005% or more. However, a Mo content of more than 0.50% causes excess generation of martensite, and the hole expansion formability decreases. For this reason, the Mo content is preferably 0.50% or less.

Cu: 0.50% or Less

Copper is an element that contributes to enhancing strength through solid solution strengthening, and by promoting generation of a second phase such as a martensite phase. Copper may be added as required. In order to obtain these effects, copper is contained in an amount of preferably 0.01% or more. However, when the Cu content is more than 0.50%, the effect becomes saturated, and surface defects due to copper tend to occur. For this reason, the Cu content is preferably 0.50% or less.

Ni: 0.50% or Less

As with the case of copper, nickel is an element that contributes to enhancing strength through solid solution strengthening, and by promoting generation of a second phase such as a martensite phase. Nickel may be added as required. In order to obtain these effects, nickel is contained in an amount of preferably 0.01% or more. When added with copper, nickel acts to reduce the surface defects due to copper, and it is effective to add nickel when adding copper. The Ni content is preferably 0.50% or less because the effect becomes saturated when the Ni content is more than 0.50%.

B: 0.01% or Less

Boron is an element that improves quenchability, and contributes to enhancing strength by generating a second phase, and may be added as required. In order to obtain this effect, boron is contained in an amount of preferably 0.0002% or more. The B content is preferably 0.01% or less because the effect becomes saturated when boron is contained in an amount of more than 0.01%.

Ca and/or REM: 0.005% or Less in Total

Ca and REM are elements that make the sulfide spherical in shape, and contribute to reducing the adverse effect of sulfides on hole expansion formability, and may be added, as required. In order to obtain these effects, Ca and REM are contained in a total amount of preferably 0.0005% or more (the content of Ca or REM when only one of these elements is contained). Because the effect becomes saturated when the total content is more than 0.005%, the total content is preferably 0.005% or less.

The balance is Fe and unavoidable impurities. Examples of the unavoidable impurities include Sb, Sn, Zn, and Co. The acceptable contents of these elements are 0.01% or less for Sb, 0.10% or less for Sn, 0.10% or less for Zn, and 0.10% or less for Co. The effects of the present invention will not be lost even when Ta, Mg, and Zr are contained in amounts used in common steel compositions.

Micro Structure

The steel sheets according to embodiments of the present invention, including the plated steel sheet, have a micro structure that contains 75 to 95% of ferrite, 3 to 15% of martensite, 0.5 to 10% of perlite, and 10% or less (including 0%) of unrecrystallized ferrite by volume, and a low-temperature occurring phase representing the remainder, and in which the ferrite has an average crystal grain diameter of 6 μm or less, and the martensite has an average crystal grain diameter of 3 μm or less, and an average aspect ratio of 4.0 or less, and in which a Nb base precipitate having an average grain diameter of 0.10 μm or less is contained. Here and below, the volume fraction is a volume fraction with respect to the total steel sheet. Property values, including the volume fraction and the average grain diameter, are values as measured by the methods described in Examples.

Ferrite: 75 to 95%

The hard second phase (a phase other than the ferrite phase, specifically, for example, martensite, perlite, unrecrystallized ferrite, bainite, retained austenite, and spherical cementite) becomes abundant when the volume fraction of ferrite is less than 75%. In this case, a large hardness difference occurs between the soft ferrite phase and the hard second phase in many parts of the micro structure, and the hole expansion formability decreases. To avoid this, the volume fraction of the ferrite phase is 75% or more. The volume fraction of the ferrite phase is preferably 82% or more. The upper limit of the volume fraction of ferrite is 95% because, when the ferrite is more than 95% by volume, the hard second phase reduces, and it becomes difficult to provide tensile strength. The volume fraction of the ferrite phase is preferably 92% or less, further preferably less than 90%.

Average Crystal Grain Diameter of Ferrite: 6 μm or Less

When the average grain diameter (average crystal grain diameter) of ferrite is more than 6 μm, voids tend to join together at the time of hole expansion. In this case, desirable hole expansion formability cannot be obtained, and coarse crystal grains are produced in the HAZ at the steel sheet surface at the time of spot welding. This makes it difficult to reduce surface cracking, an important element in an embodiment of the present invention. For this reason, the average crystal grain diameter of ferrite is 6 μm or less. The average crystal grain diameter of ferrite is preferably 5 μm or less. From the standpoint of production cost, the lower limit of the average crystal grain diameter of ferrite is preferably 0.3 μm or more.

Martensite: 3 to 15%

The volume fraction of martensite is 3% or more to provide the desired tensile strength and yield ratio. The volume fraction of martensite is preferably 5% or more. The volume fraction of martensite is 15% or less because the yield ratio decreases when the volume fraction of the hard martensite is more than 15%. The volume fraction of martensite may be less than 15%. The volume fraction of martensite is preferably 13% or less, further preferably 11% or less, more preferably less than 10%, most preferably 9% or less.

As noted above, the present invention may contain small amounts of bainite. The total content of martensite and bainite is usually less than 15%, typically 13% or less.

Average Crystal Grain Diameter of Martensite: 3 μm or Less

Average Aspect Ratio of Martensite: 4.0 or Less

When the average aspect ratio of martensite is more than 4.0, the carbon and manganese that have concentrated in the martensite do not uniformly disperse in the austenite when a high temperature is reached in resistance welding in the HAZ at the steel sheet surface at the time of spot welding. This creates an uneven hardness distribution in the micro structure in HAZ, and surface cracking tends to occur at the time of spot welding. The martensite is preferably close to spherical in shape when surface cracking is to be reduced at the time of spot welding. The average aspect ratio of martensite is therefore 4.0 or less, preferably 3.5 or less. From the standpoint of achieving a more spherical shape, the average aspect ratio is preferably 0.25 or more. As used herein, "aspect ratio" means a value obtained by dividing the longer side of an equivalent ellipsoid by its shorter side (longer side/shorter side).

When the average crystal grain diameter of martensite is more than 3 μm, the voids generated the interface between martensite and ferrite tend to join together, and the hole expansion formability deteriorates. The upper limit of the average crystal grain diameter of martensite is therefore μm. The preferred average crystal grain diameter of martensite is 2 μm or less. From the standpoint of production cost, the lower limit of the average crystal grain diameter of martensite is preferably 0.3 μm or more.

Perlite: 0.5 to 10%

When the micro structure contains perlite, a high yield ratio can be obtained while providing tensile strength. The volume fraction of perlite is 0.5% or more because it becomes difficult to obtain a high yield ratio when the perlite is less than 0.5% by volume. The upper limit of the volume fraction of perlite is 10% because the hole expansion formability decreases when perlite is more than 10% by volume. The preferred volume fraction of perlite is 8% or less.

Unrecrystallized Ferrite: 10% or Less (Including 0%)

When the micro structure contains unrecrystallized ferrite, a high yield ratio can be obtained while providing tensile strength. However, when the volume fraction of unrecrystallized ferrite is more than 10%, the ductility decreases, and, because of high dislocation density, the micro structure suffers from poor toughness, and surface cracking tends to occur at the time of spot welding. For this reason, the volume fraction of unrecrystallized ferrite is 10% or less. The volume fraction of unrecrystallized ferrite is preferably 8% or less, more preferably less than 5%.

Other Phase

The micro structure may include a structure other than ferrite, martensite, perlite, and unrecrystallized ferrite. In this case, the remainder structure may be a low-temperature occurring phase selected from, for example, bainite, retained austenite, and spherical cementite, or a composite structure combining two or more of these phases. For formability (elongation), the total volume fraction of the remainder other than ferrite, martensite, perlite, and unrecrystallized ferrite is preferably less than 5.0%. Accordingly, the remainder structure may be 0% by volume. Typically, the retained austenite is contained in small amounts, for example, less than 4%, or 3% or less.

Nb Base Precipitate Having Average Grain Diameter of 0.10 μm or Less

The micro structure needs to contain a Nb base precipitate having an average grain diameter of 0.10 μm or less. When the average grain diameter of the Nb base precipitate is more than 0.10 μm, the yield strength of the steel sheet cannot increase via precipitation strengthening, and the yield ratio decreases. It also becomes difficult to refine the ferrite and the martensite, and the hole expansion formability and spot weldability decrease after annealing. The preferred average grain diameter is 0.08 μm or less. Here, "Nb base precipitate" means a carbide, a nitride, or a carbonitride of niobium, and may be at least one of a carbide, a nitride, or a carbonitride of niobium.

Steel Sheet

The steel sheet has the composition and the micro structure described above. The steel sheet has a thickness of typically 0.4 mm to 3.2 mm, though it is not particularly limited.

Plated Steel Sheet

The plated steel sheet of the present invention is a plated steel sheet having a plating layer on the steel sheet of the present invention. The plating layer is not particularly limited, and may be, for example, a hot-dip plating layer, or an electroplating layer. The plating layer may be an alloyed plating layer. The plating layer is preferably a galvanized layer. The galvanized layer may contain aluminum or magnesium. A hot-dip zinc-aluminum-magnesium alloyed plating (a Zn—Al—Mg plating layer) is also preferred. In this case, it is preferable that the Al content be 1 mass % to 22 mass %, the Mg content be 0.1 mass % to 10 mass %, and the balance be zinc. The Zn—Al—Mg plating layer may contain at least one selected from Si, Ni, Ce, and La in a total amount of 1 mass % or less, in addition to Zn, Al, and Mg. The plated metal is not particularly limited, and other metals, for example, aluminum may be used for plating, other than zinc. The plated metal is not particularly limited, and other metals, for example, aluminum may be used for plating, other than zinc.

The composition of the plating layer is not particularly limited either, and the plating layer may have a common composition. For example, in the case of a hot-dip galvanized layer or a hot-dip galvannealed layer, the composition typically contains Fe: 20 mass % or less, Al: 0.001 mass % to 1.0 mass %, one or more selected from Pb, Sb, Si, Sn, Mg, Mn, Ni, Cr, Co, Ca, Cu, Li, Ti, Be, Bi, and REM in a total amount of 0 mass % to 3.5 mass %, and the balance Zn and unavoidable impurities. In the present invention, it is preferable to provide a hot-dip galvanized layer deposited with 20 to 120 g/m$^2$ of plating each side, and a hot-dip galvannealed layer formed by alloying such a hot-dip galvanized layer. This is because a deposition amount of less than 20 g/m$^2$ makes it difficult to provide corrosion resistance. With a deposition amount of more than 120 g/m$^2$, the plating may suffer from poor resistance against detachment. As a guide, the Fe content in the plating layer is less than 7 mass % when the plating layer is a hot-dip galvanized layer, and 7 to 20 mass % when the plating layer is a hot-dip galvannealed layer.

Hot-Rolled Steel Sheet Producing Method

The method for producing a hot-rolled steel sheet is a method that includes:

hot rolling a steel material of the composition above under the conditions where the rolling reduction of the final pass of the finish rolling is 12% or more, the rolling reduction of the preceding pass of the final pass is 15% or more, and the finisher delivery temperature is 850 to 950° C.;

subjecting the steel after the hot rolling to primary cooling in which the steel is cooled to a cooling stop temperature at a first average cooling rate of 75° C./s or more, the cooling stop temperature being 700° C. or less;

subjecting the steel after the primary cooling to secondary cooling in which the steel is cooled to a coiling temperature at a second average cooling rate of 5° C./s or more and less than 75° C./s; and coiling the steel at a coiling temperature of 450 to 650° C.

In the following descriptions, "temperature" means steel sheet surface temperature, unless otherwise specifically stated. Steel sheet surface temperature can be measured with a radiation thermometer or the like.

Preferably, the steel slab (steel material) used is produced by continuous casting to prevent macro segregation of the components. The steel material also may be produced by ingot casting, or thin slab casting.

For hot rolling, it is preferable to start hot rolling of the cast steel slab at 1,150 to 1,270° C. without reheating, or after reheating the steel material to 1,150 to 1,270° C. In a preferred hot-rolling condition, the steel slab is hot rolled at a hot-rolling start temperature of 1,150 to 1,270° C. In the present invention, the steel slab produced may be processed by the traditional method where the steel slab is cooled to room temperature, and reheated, or may be processed using a low-energy process, for example, such as direct transfer rolling/direct rolling, in which the steel slab is placed in a heating furnace while it is still warm, without cooling, or the steel slab is rolled immediately after retaining heat, or is rolled directly after being cast.

Rolling Reduction of Final Pass of Finish Rolling is 12% or More

Rolling Reduction of Preceding Pass of Final Pass is 15% or More

The rolling reduction of the final pass of the finish rolling is 12% or more. This is necessary from the standpoint of introducing large numbers of shear bands in austenite grains, and increasing the nucleation site of ferrite transformation after hot rolling so that a fine hot-rolled sheet is obtained. The rolling reduction of the final pass of the finish rolling is preferably 13% or more. The upper limit is not particularly limited, and is preferably 30% or less because the hot-rolling load otherwise increases, and causes large fluctuations of sheet thickness across the sheet width, and a change in material uniformity.

The rolling reduction of the preceding pass of the final pass is 15% or more. This is necessary from the standpoint of increasing the strain accumulation effect, and introducing larger numbers of shear bands in austenite grains so that the nucleation site of ferrite transformation further increases, and the hot-rolled sheet has an even finer structure. The rolling reduction of the preceding pass of the final pass is preferably 15% or more. The upper limit is not particularly limited, and is preferably 30% or less because the hot-rolling load otherwise increases, and causes large fluctuations of sheet thickness across the sheet width, and a change in material uniformity.

Finisher Delivery Temperature: 850 to 950° C.

The hot rolling must end in an austenite single phase, in order to make the steel sheet structure uniform, and to reduce the anisotropy of the material, and improve the elongation and hole expansion formability after annealing. To this end, the finisher delivery temperature is 850° C. or more. A finisher delivery temperature of more than 950° C. produces a coarse hot-rolled structure, and impairs the properties after annealing. The finisher delivery temperature is therefore 850 to 950° C.

Primary Cooling

The primary cooling is performed under the condition that the first average cooling rate to a cooling stop temperature is 75° C./s or more, the cooling stop temperature being 700° C. or less.

After the hot rolling, the cooling conditions are adjusted to control the state of the fine precipitates of niobium after the annealing (heating and cooling after the cold rolling) described later. Controlling the precipitation state also makes it possible to refine the ferrite and the martensite in the final micro structure. When the average cooling rate to the cooling stop temperature in the primary cooling is less than 75° C./s, niobium forms large amounts of precipitates in an accelerated fashion, and the precipitates coarsen. This makes it difficult to contribute to producing a fine steel sheet, with the result that the hole expansion formability and spot weldability decrease after annealing. When the cooling stop temperature of primary cooling is more than 700° C., excess generation of perlite occurs in the hot-rolled steel sheet, and the hot-rolled steel sheet has a nonuniform micro structure, with the result that the hole expansion formability and spot weldability decrease after annealing. The cooling stop temperature may be any temperature in the range of 700° C. or less, and is preferably 600° C. or more. The cooling stop temperature, however, is a temperature higher than the coiling temperature.

Secondary Cooling

The secondary cooling is performed after the primary cooling under the condition that the second average cooling rate to a coiling temperature is 5° C./s or more and less than 75° C./s.

When the average cooling rate is less than 5° C./s, the Nb base precipitates coarsen, and it becomes difficult to produce a fine micro structure after annealing. When the cooling rate is controlled until the temperature is still higher than 650° C., the Ti and Nb base precipitates coarsen, and it becomes difficult to produce a fine steel sheet structure after annealing. When the average cooling rate is 75° C./s or more, the Ti and Nb base precipitates forming a solid solution after the coiling remain, and it becomes difficult to produce a fine steel sheet structure after annealing. For this reason, the average cooling rate is controlled until the temperature reaches the coiling temperature, specifically 650° C. or less. When the cooling stop temperature (corresponding to the coiling temperature) is less than 450° C., the amount of Nb base precipitates becomes smaller, and the amount of solid solution increases in the steel sheet, making it difficult to produce a fine steel sheet structure after the final annealing. The cooling stop temperature is therefore 450° C. or more.

Coiling Temperature: 450 to 650° C.

When the coiling temperature in the coiling performed after the secondary cooling is more than 650° C., excess generation of perlite occurs, and the micro structure becomes nonuniform, coarsening the Ti and Nb base precipitates. The upper limit of coiling temperature is therefore 650° C., preferably 630° C. or less. When the coiling temperature is less than 450° C., the solid solution of titanium and niobium in the steel sheet increases, and it becomes difficult to make a fine micro structure. The lower limit of coiling temperature is therefore 450° C.

Once coiled, the steel sheet is cooled by air or by some other means, and is used to produce a cold-rolled full hard steel sheet, as described below. When the hot-rolled steel sheet is to be sold in the form of an intermediate product, the hot-rolled steel sheet is typically prepared into a commercial product after being coiled and cooled.

Cold-Rolled Full-Hard Steel Sheet Producing Method

The method for producing a cold-rolled full-hard steel sheet (an as-cold rolled steel sheet) of the present invention is a method that produces a cold-rolled full-hard steel sheet by cold rolling the hot-rolled steel sheet produced by using the method described above.

The cold rolling conditions are appropriately set according to, for example, factors such as the desired thickness. In an embodiment of the present invention, the steel sheet is cold rolled at a rolling reduction of preferably 30% or more. When the rolling reduction is low, ferrite recrystallization may not be promoted, and unrecrystallized ferrite may occur in excess, and cause deterioration of ductility and hole expansion formability. The rolling reduction of cold rolling is typically 95% or less.

The hot-rolled steel sheet needs to be pickled before cold rolling to descale the sheet surface. The pickling conditions may be appropriately set.

Steel Sheet Producing Method

The steel sheet producing method includes a method that produces a steel sheet by heating and cooling the cold-rolled full-hard steel sheet (single method), and a method in which the cold-rolled full-hard steel sheet is heated and cooled to produce a heat-treated sheet, and the heat-treated sheet is heated and cooled to produce a steel sheet (double method). The single method is described first.

Maximum Achieving Temperature is 730 to 900° C.

When the maximum achieving temperature is less than 730° C., recrystallization of the ferrite does not proceed sufficiently, and excess unrecrystallized ferrite occurs in the micro structure, with the result that formability deteriorates. It also becomes difficult to form a second phase, which is necessary in an embodiment of the present invention. When the maximum achieving temperature is higher than 900° C., the precipitates coarsen, and it becomes difficult to provide a fine micro structure, with the result that the desired average crystal grain diameter cannot be provided for ferrite and martensite.

The heating conditions in the heating to the maximum achieving temperature are not particularly limited. It is, however, preferable that the average heating rate be 2 to 50° C./s. This is because, when the average heating rate is less than 2° C./s, the Nb base precipitates coarsen during heating, and it becomes difficult to make a fine micro structure. When the average heating rate is higher than 50° C./s, the steel may reach a temperature where γ generation takes place, before recrystallization sufficiently proceeds. This may result in excess unrecrystallized ferrite.

Retention (Holding) Time at Maximum Achieving Temperature is 15 to 600 Seconds

When the retention time is less than 15 seconds, ferrite recrystallization does not proceed sufficiently, and excess unrecrystallized ferrite will be present in the micro structure, with the result that formability deteriorates. Formation of the second phase, which is necessary in an embodiment of the present invention, also becomes difficult. When the retention time is more than 600 seconds, the ferrite coarsens, and the hole expansion formability deteriorates. For this reason, the retention time is 600 seconds or less.

Average Cooling Rate to Cooling Stop Temperature is 3 to 30° C./s Cooling Stop Temperature is 600° C. or Less The heating must be followed by cooling to the cooling stop temperature at an average cooling rate of 3 to 30° C./s. With an average cooling rate of less than 3° C./s, ferrite transformation occurs during the cooling, and the volume fraction of martensite decreases. This makes it difficult to provide strength. With an average cooling rate of more than 30° C./s, excess generation of martensite occurs, and it becomes difficult to provide hole expansion formability. When the temperature region in which the cooling rate is controlled is higher than 600° C., excess generation of perlite occurs, and the predetermined volume fraction cannot be obtained for the different phases of the micro structure, with the result that the ductility (formability) and hole expansion formability decrease. A cooling stop temperature of 600° C. or less is therefore necessary, as stated above.

The dew point in a temperature region of 600° C. or more is −40° C. or less. In this way, decarburization from the steel sheet surface during annealing can be reduced, and the tensile strength of 590 MPa or more specified by the present invention can be stably achieved. The tensile strength of the steel sheet may fall below 590 MPa as a result of decarburization when the dew point in the foregoing temperature region is higher than −40° C. Accordingly, the dew point in the foregoing temperature region is set to −40° C. or less. The lower limit of the atmospheric dew point is not particularly limited, and is preferably −80° C. or more because the effect becomes saturated, and creates a cost disadvantage when the dew point is less than −80° C. It is to be noted here that the temperature in the foregoing temperature region is based on the surface temperature of the steel sheet. That is, the dew point is adjusted in the foregoing range when the steel sheet surface temperature is in the foregoing temperature region.

When the steel sheet is to be sold, the steel sheet is cooled to room temperature after being cooled in the foregoing cooling process, or after the temper rolling described below, before being prepared into a commercial product.

The following describes the double method. In the double method, the cold-rolled full-hard steel sheet is heated and cooled to make a heat-treated sheet. The method that produces the heat-treated sheet is the method for producing a heat-treated sheet of the present invention.

The heating that produces the heat-treated sheet is performed at a heating temperature of 700 to 900° C. When the heating is performed under this condition, the fine precipitates can evenly exist in the micro structure, and formation of a fine micro structure can take place in an accelerated fashion. The heating temperature is therefore 700 to 900° C.

The effect cannot be sufficiently obtained with a heating temperature of less than 700° C. With a heating temperature of more than 900° C., the precipitates coarsen, and it becomes difficult to obtain a fine micro structure in the subsequent heating of the heat-treated sheet.

The heating is followed by cooling. The cooling conditions are not particularly limited. Typically, the cooling is performed at an average cooling rate of 1 to 30° C./s.

The heating method is not particularly limited. Preferably, the heating is performed using a continuous annealing line (CAL), or a batch annealing furnace (BAF).

In the double method, the heat-treated sheet is further heated and cooled. The heating and cooling conditions (including a maximum achieving temperature, a dew point, a retention time, an average cooling rate, and a cooling stop temperature) are the same as those described for the cold-rolled full-hard steel sheet in conjunction with the single method. As such, these will not be described again.

The steel sheet obtained by the method described above may be subjected to temper rolling, and the temper-rolled steel sheet may be regarded as the steel sheet of the present invention. The stretch rate is preferably 0.05 to 2.0%.

Plated Steel Sheet Producing Method

The method for producing a plated steel sheet of the present invention is a method that produces a plated steel sheet by plating the steel sheet obtained in the manner described above.

For example, the plating process may be hot-dip galvanization, or a process that involves alloying after hot-dip galvanization. Annealing and galvanization may be continuously performed in a single line. As another example, a plating layer may be formed by electroplating such as Zn—Ni alloy electroplating, or by hot-dip zinc-aluminum-magnesium alloy plating. Though the above description focuses on galvanization, the type of plated metal is not particularly limited, and the plating may be, for example, Zn plating, or Al plating. The plating process includes a process in which plating is performed after annealing, and a process in which annealing and plating are continuously performed in a plating line.

As an example, the following describes hot-dip galvanization.

The steel sheet temperature of the steel sheet dipped in a plating bath ranges preferably from (hot-dip galvanization bath temperature 40°) C. to (hot-dip galvanization bath temperature+50°) C. When the temperature of the steel sheet dipped in a plating bath is below (hot-dip galvanization bath temperature−40°) C., the molten zinc may partially solidify upon dipping the steel sheet in the plating bath, and the appearance of the plating may deteriorate. The preferred lower limit is therefore (hot-dip galvanization bath temperature−40°) C. The plating bath temperature increases when the temperature of the steel sheet dipped in a plating bath is above (hot-dip galvanization bath temperature+50°) C. This poses a problem in mass production. The preferred upper limit is therefore (hot-dip galvanization bath temperature+50°) C.

The hot-dip plating may be followed by an alloying treatment in a temperature region of 450 to 600° C. By performing an alloying treatment in a temperature region of 450 to 600° C., the Fe concentration in the plating becomes 7 to 15%, and improves the plating adhesion, and the corrosion resistance after the coating. Alloying does not proceed sufficiently when the alloying temperature is less than 450° C. This may lead to poor sacrificial anticorrosion effect, and poor slidability. When the alloying temperature is more than 600° C., alloying proceeds predominantly, and the powdering property deteriorates.

For productivity, a series of processes including the annealing (heating and cooling of the sheet sheets, including the cold-rolled full-hard steel sheet), the hot-dip plating, and the alloying treatment is preferably performed in a continuous hot-dip galvanization line (CGL). Preferably, the hot-dip galvanization uses a galvanization bath containing 0.10 to 0.20% of aluminum. The plating may be followed by wiping to adjust the deposition amount of plating.

As described above in conjunction with the plating layer, the plating is preferably Zn plating. It is possible, however, to use other metals, such as in Al plating.

EXAMPLES

Examples of the present invention are described below. However, the present invention is not to be limited by the following Examples, and may be implemented in various modifications as appropriately made within the scope conforming to the gist of the present invention, and such modifications all fall within the technical scope of the present invention.

Steels of the compositions shown in Table 1 were cast to produce slabs. The slabs (of the same thickness) were each hot rolled into a hot-rolled steel sheet (thickness: 3.2 mm) under the conditions where the hot-rolling heating temperature is 1,250° C., and the rolling reduction of the final pass, and the rolling reduction of the preceding pass of the final pass, and the finisher delivery temperature (FDT) are as shown in Table 2. The hot-rolled steel sheet was cooled to a first cooling temperature at the first average cooling rate (cooling rate 1) shown in Table 2, and to a coiling temperature at the second average cooling temperature (cooling rate 2), and was coiled at a coiling temperature (CT). The resulting hot-rolled sheet was pickled, and cold rolled to produce a cold-rolled sheet (thickness: 1.4 mm; the cold-rolled sheet corresponds to the cold-rolled full-hard steel sheet). In a continuous hot-dip galvanization line, the cold-rolled sheet was heated and cooled (annealing) under the conditions shown in Table 2, and was subjected to hot-dip galvanization. This was followed by an alloying treatment at the temperatures shown in Table 2 to obtain hot-dip galvannealed steel sheets. As shown in Table 2, some of the cold-rolled steel sheets were subjected to a first heat treatment at the temperatures shown in Table 2, using a continuous annealing line, and were plated in a continuous hot-dip galvanization line. As shown in Table 2, alloying of the plating was not performed for some of the steel sheets. The plating was performed under the following conditions.

Galvanization Bath Temperature: 460° C.,

Al concentration in galvanization bath: 0.14 mass % (when alloying is performed), 0.18 mass % (when alloying is not performed)

Plating deposition amount: 45 g/m$^2$ (each side)

TABLE 1

| Steel type | Chemical composition (mass %) C | Si | Mn | P | S | Al | N | Ti | Nb | Other components | Remarks |
|---|---|---|---|---|---|---|---|---|---|---|---|
| A | 0.07 | 0.01 | 1.87 | 0.02 | 0.002 | 0.03 | 0.003 | 0.02 | 0.04 | — | Compliant steel |
| B | 0.09 | 0.25 | 1.72 | 0.02 | 0.002 | 0.02 | 0.003 | 0.02 | 0.03 | V: 0.05 | Compliant steel |
| C | 0.09 | 0.45 | 1.68 | 0.02 | 0.002 | 0.03 | 0.003 | 0.02 | 0.04 | — | Compliant steel |
| D | 0.07 | 0.22 | 1.69 | 0.02 | 0.002 | 0.03 | 0.003 | 0.02 | 0.03 | Cr: 0.22 | Compliant steel |
| E | 0.08 | 0.12 | 1.55 | 0.02 | 0.001 | 0.02 | 0.002 | 0.03 | 0.03 | Mo: 0.15 | Compliant steel |
| F | 0.08 | 0.03 | 1.66 | 0.02 | 0.002 | 0.03 | 0.003 | 0.04 | 0.03 | B: 0.001 | Compliant steel |
| G | 0.08 | 0.08 | 1.88 | 0.02 | 0.002 | 0.03 | 0.003 | 0.02 | 0.04 | Cu: 0.12, Ni: 0.12 | Compliant steel |
| H | 0.06 | 0.40 | 1.81 | 0.02 | 0.001 | 0.03 | 0.001 | 0.02 | 0.03 | Ca: 0.002 | Compliant steel |
| I | 0.07 | 0.28 | 1.88 | 0.03 | 0.002 | 0.03 | 0.002 | 0.03 | 0.03 | REM: 0.002 | Compliant steel |
| J | 0.15 | 0.22 | 1.55 | 0.03 | 0.003 | 0.03 | 0.003 | 0.02 | 0.05 | — | Comparative Example |
| K | 0.07 | 0.11 | 2.33 | 0.02 | 0.002 | 0.03 | 0.002 | 0.03 | 0.04 | — | Comparative Example |
| L | 0.09 | 0.20 | 1.11 | 0.02 | 0.003 | 0.03 | 0.002 | 0.02 | 0.02 | — | Comparative Example |
| M | 0.08 | 0.03 | 1.64 | 0.02 | 0.002 | 0.03 | 0.003 | — | — | — | Comparative Example |
| N | 0.09 | 0.12 | 1.88 | 0.02 | 0.002 | 0.02 | 0.003 | | 0.03 | — | Comparative Example |
| O | 0.10 | 0.28 | 1.66 | 0.03 | 0.002 | 0.02 | 0.003 | 0.12 | 0.02 | — | Comparative Example |
| P | 0.09 | 0.43 | 1.78 | 0.02 | 0.002 | 0.02 | 0.004 | 0.02 | — | — | Comparative Example |
| Q | 0.09 | 0.21 | 1.77 | 0.03 | 0.002 | 0.02 | 0.003 | 0.02 | 0.21 | — | Comparative Example |

TABLE 2

| Sample No. | Steel type | Hot rolling: Preceding pass of final pass % | Final pass % | FDT ° C. | Cooling rate 1*1 ° C./s | Cooling stop temp. ° C. | Cooling rate 2*2 ° C. | CT ° C. | First annealing Heating temp. ° C. | Final annealing: Dew point*3 ° C. | Maximum achieving temp. ° C. | Retention time second | Cooling rate 3*4 ° C./s | Cooling stop temp. ° C. | Alloying temp. ° C. | Remarks |
|---|---|---|---|---|---|---|---|---|---|---|---|---|---|---|---|---|
| 1 | A | 18 | 13 | 880 | 100 | 660 | 20 | 620 | — | −50 | 820 | 300 | 5 | 525 | 525 | PE |
| 2 | B | 18 | 12 | 880 | 100 | 680 | 20 | 620 | — | −45 | 820 | 300 | 5 | 525 | — | PE |
| 3 | C | 18 | 13 | 880 | 90 | 660 | 20 | 600 | — | −45 | 820 | 300 | 5 | 525 | 525 | PE |
| 4 | D | 18 | 14 | 880 | 100 | 680 | 20 | 620 | — | −47 | 780 | 300 | 8 | 525 | 525 | PE |
| 5 | E | 18 | 15 | 880 | 120 | 680 | 20 | 450 | — | −50 | 820 | 300 | 8 | 525 | 525 | PE |
| 6 | F | 20 | 12 | 880 | 110 | 660 | 30 | 600 | — | −48 | 850 | 300 | 10 | 525 | 600 | PE |
| 7 | G | 18 | 15 | 880 | 100 | 660 | 25 | 550 | — | −48 | 820 | 600 | 8 | 525 | — | PE |
| 8 | H | 18 | 15 | 880 | 100 | 660 | 25 | 550 | — | −48 | 800 | 600 | 8 | 525 | — | PE |
| 9 | I | 20 | 15 | 880 | 150 | 600 | 25 | 500 | — | −48 | 800 | 600 | 5 | 525 | 525 | PE |
| 10 | A | 18 | 15 | 880 | 20 | 680 | 25 | 600 | — | −50 | 830 | 600 | 10 | 525 | 525 | CE |
| 11 | A | 18 | 15 | 880 | 80 | 750 | 25 | 640 | — | −45 | 830 | 300 | 8 | 525 | 525 | CE |
| 12 | A | 18 | 15 | 880 | 100 | 680 | 2 | 640 | — | −45 | 830 | 300 | 8 | 525 | 525 | CE |
| 13 | B | 18 | 15 | 880 | 100 | 680 | 25 | 300 | — | −47 | 830 | 600 | 8 | 525 | 600 | CE |
| 14 | B | 18 | 13 | 880 | 80 | 680 | 25 | 700 | — | −50 | 800 | 300 | 8 | 525 | 525 | CE |
| 15 | B | 18 | 13 | 880 | 100 | 680 | 25 | 600 | — | −48 | 700 | 300 | 5 | 525 | 525 | CE |
| 16 | B | 20 | 14 | 880 | 100 | 650 | 20 | 600 | — | −48 | 950 | 600 | 8 | 525 | 525 | CE |
| 17 | C | 18 | 14 | 880 | 100 | 650 | 20 | 600 | — | −48 | 820 | 600 | 1 | 525 | 525 | CE |
| 18 | C | 18 | 14 | 880 | 100 | 650 | 30 | 600 | — | −50 | 820 | 600 | 5 | 700 | 525 | CE |
| 19 | J | 18 | 15 | 880 | 100 | 650 | 20 | 600 | — | −45 | 820 | 300 | 5 | 525 | 525 | CE |
| 20 | K | 18 | 13 | 880 | 100 | 650 | 20 | 600 | — | −45 | 820 | 300 | 5 | 525 | 525 | CE |
| 21 | L | 18 | 15 | 880 | 100 | 650 | 25 | 600 | — | −47 | 820 | 600 | 5 | 525 | 525 | CE |
| 22 | M | 18 | 15 | 880 | 120 | 660 | 25 | 600 | — | −50 | 830 | 600 | 5 | 525 | 525 | CE |
| 23 | N | 18 | 15 | 880 | 80 | 650 | 25 | 580 | — | −48 | 830 | 600 | 5 | 525 | 525 | CE |
| 24 | O | 20 | 15 | 880 | 100 | 650 | 20 | 580 | — | −48 | 750 | 300 | 5 | 525 | 525 | CE |
| 25 | P | 18 | 15 | 880 | 80 | 650 | 20 | 580 | — | −48 | 820 | 600 | 5 | 525 | 525 | CE |
| 26 | Q | 18 | 15 | 880 | 100 | 650 | 20 | 580 | — | −48 | 780 | 300 | 8 | 525 | 525 | CE |
| 27 | A | 18 | 15 | 880 | 100 | 650 | 25 | 600 | 750 | −48 | 820 | 300 | 5 | 525 | 525 | PE |
| 28 | A | 18 | 15 | 880 | 100 | 650 | 25 | 580 | 750 | −48 | 830 | 600 | 5 | 525 | 525 | PE |
| 29 | B | 18 | 15 | 880 | 120 | 650 | 20 | 580 | 780 | −48 | 830 | 600 | 5 | 525 | 525 | PE |
| 30 | B | 18 | 15 | 880 | 100 | 650 | 20 | 580 | — | −35 | 800 | 300 | 5 | 525 | 525 | CE |
| 31 | B | 18 | 15 | 880 | 100 | 650 | 90 | 480 | — | −44 | 790 | 300 | 5 | 525 | 525 | CE |
| 32 | A | 12 | 5 | 880 | 100 | 620 | 20 | 560 | — | −45 | 800 | 600 | 5 | 525 | 525 | CE |

*1First average cooling rate to cooling stop temperature

*2Second average cooling rate to coiling temperature

*3Dew point in a temperature range of 600° C. or more

*4Average cooling rate to cooling stop temperature

PE: Example of the present invention;

CE: Comparative example

A JIS 5 tensile test strip was collected from the steel sheet in such an orientation that the direction orthogonal to the rolling direction was the longitudinal direction (tensile direction) of the test strip. The test strip was then measured for tensile strength (TS), total elongation (EL), and yield strength (YS) in a tensile test (JIS 22241 (1998)). The yield ratio (YR) was also calculated.

For hole expansion formability, the steel sheet was punched to make a hole (ϕ=10 mm) with 12.5% clearance according to the Japan Iron and Steel Federation (JFS T1001 (1996)) standards. The steel sheet was set on a tester in such an orientation that the burr was on the die side, and was measured for hole expansion rate (λ) by shaping the hole with a 60° conical punch. The steel sheet was determined as having desirable hole expansion formability when it had a hole expansion rate λ (%) of 60% or more.

For spot weldability, a pair of the hot-dip galvanized steel sheets produced in the manner described above was subjected to resistance spot welding to make a resistance spot-welded joint, using a resistance welding machine attached to a C-gun and operated under single-phase alternate current (50 Hz) with a compression servomotor. The pair of electrode tips used is of a DR-type electrode of alumina-dispersed copper having a tip curvature radius R40, and a tip diameter of 6 mm. The welding was performed under an applied pressure of 3,500 N with 18 cycles of weld time, and 1 cycle of hold time. For each hot-dip galvanized steel sheet, the current value at which splash occurs was determined, and the hot-dip galvanized steel sheet was tested again with a current value 0.1 kA lower than the current value that causes splash. The surface of the hot-dip galvanized steel sheet was then observed for the presence or absence of a crack, using a microscope. The hot-dip galvanized steel sheet was determined as "Poor" when it had a surface crack, and "Good" when it did not have a surface crack. Here, surface cracking was determined as being present when a crack was present inside a circle of 7-mm diameter created around the center of a nugget. Here, "crack" means a crack having a length of 100 μm or more.

The volume fractions of the ferrite, martensite, perlite, and unrecrystallized ferrite in the steel sheet were obtained in the following fashion. A cross section taken along the rolling direction of the steel sheet was polished, corroded with 3% nital, and observed at a ¼ thickness position from surface, using a SEM (scanning electron microscope) at 2,000 and 5,000 times magnifications. The area percentage was then measured according to the point counting method (ASTM E562-83 (1988)), and the measured area percentage was recorded as a volume fraction. For the calculation of the average crystal grain diameters of ferrite and martensite, the area of each phase can be calculated by incorporating pictures that have identified the ferrite and martensite crystal grains from pictures of the micro structure, using the Image-Pro available from Media Cybernetics. The average crystal grain diameters of ferrite and martensite were determined by calculating the diameters of corresponding circles, and averaging the calculated values. The aspect ratio of martensite was determined by determining the aspect ratio of each grain from the picture of the micro structure, and by averaging the measured aspect ratios.

The remainder structure was also confirmed. The results are presented in Table 3.

The average grain diameter of Nb base precipitates was determined as follows. A thin film obtained from a ¼ thickness position from the surface of the steel sheet was observed in 10 fields with a transmission electron microscope (TEM) (the micrograph was enlarged at 500,000 times magnification), and the average grain diameter of the precipitates was determined. The grain diameter of the precipitate is the diameter of the precipitate when the precipitate is spherical in shape. For elliptical precipitates, measurements were made for the long axis a of the precipitate, and for the short axis orthogonal to the long axis, and the square root of the product of long axis a and short axis b was calculated as the grain diameter. The grain diameters of the precipitates observed in 10 fields were added, and divided by the number of the precipitates to find the average grain diameter of carbides.

Table 3 shows the measurement results for tensile characteristics, hole expansion rate, spot weldability, and micro structure.

As can be seen from the results shown in Table 3, the examples according to embodiments of the present invention all had a yield ratio of 70% or more, a tensile strength of 590 MPa or more, an elongation of 28% or more, and a hole expansion rate of 60% or more, and surface cracking did not occur during spot welding. On the other hand, the comparative examples did not satisfy the micro structure and composition ranges of the present invention, and were inferior in one or more of tensile strength, yield ratio, elongation, hole expansion rate, and spot weldability.

TABLE 3

| | Steel sheet structure | | | | | | | | Average | | | | | | | |
|---|---|---|---|---|---|---|---|---|---|---|---|---|---|---|---|---|
| | Ferrite | | Martensite | | | | Un-recrystal- | | grain diameter | | | | | Hole ex- | Spot | |
| Sam- | Volume | Average grain | Volume | Average grain | Average | Perlite Volume | lized ferrite Volume | Re- | of Nb base | Tensile characteristics | | | | pansion rate | weld-ability | |
| ple No. | fraction (%) | diameter (μm) | fraction (%) | diameter (μm) | aspect ratio | fraction (%) | fraction (%) | remainder structure Type | precipitate μm | TS MPa | YS MPa | YR % | EL % | λ % | Surface cracking | Re-marks |
| 1 | 90 | 4 | 8 | 3 | 3 | 2 | 0 | — | 0.04 | 612 | 455 | 74 | 29 | 65 | Good | PE |
| 2 | 89 | 5 | 7 | 3 | 3 | 3 | 1 | — | 0.05 | 633 | 466 | 74 | 29 | 66 | Good | PE |
| 3 | 92 | 4 | 5 | 3 | 2 | 3 | 0 | — | 0.03 | 622 | 478 | 77 | 30 | 65 | Good | PE |
| 4 | 88 | 4 | 8 | 3 | 2 | 2 | 2 | — | 0.03 | 605 | 445 | 74 | 31 | 62 | Good | PE |
| 5 | 90 | 5 | 6 | 3 | 3 | 2 | 0 | B | 0.04 | 609 | 442 | 73 | 29 | 69 | Good | PE |
| 6 | 88 | 5 | 6 | 3 | 3 | 5 | 0 | SC | 0.03 | 677 | 488 | 72 | 28 | 62 | Good | PE |
| 7 | 90 | 5 | 5 | 3 | 3 | 5 | 0 | — | 0.05 | 602 | 468 | 78 | 32 | 68 | Good | PE |
| 8 | 92 | 5 | 5 | 3 | 2 | 3 | 0 | — | 0.03 | 664 | 488 | 73 | 28 | 65 | Good | PE |
| 9 | 86 | 5 | 9 | 3 | 2 | 4 | 1 | — | 0.04 | 633 | 455 | 72 | 28 | 69 | Good | PE |
| 10 | 90 | 7 | 5 | 5 | 3 | 5 | 0 | — | 0.11 | 621 | 433 | 70 | 29 | 55 | Poor | CE |
| 11 | 90 | 7 | 5 | 4 | 3 | 5 | 0 | — | 0.09 | 612 | 435 | 71 | 28 | 42 | Poor | CE |

TABLE 3-continued

| Sample No. | Steel sheet structure: Ferrite Volume fraction (%) | Ferrite Average grain diameter (μm) | Martensite Volume fraction (%) | Martensite Average grain diameter (μm) | Martensite Average aspect ratio | Perlite Volume fraction (%) | Unrecrystallized ferrite Volume fraction (%) | Remainder structure Type | Average grain diameter of Nb base precipitate μm | Tensile characteristics TS MPa | YS MPa | YR % | EL % | Hole expansion rate λ % | Spot weldability Surface cracking | Remarks |
|---|---|---|---|---|---|---|---|---|---|---|---|---|---|---|---|---|
| 12 | 88 | 7 | 8 | 5 | 3 | 4 | 0 | — | 0.12 | 622 | 465 | 75 | 28 | 46 | Poor | CE |
| 13 | 89 | 8 | 9 | 4 | 2 | 2 | 0 | — | 0.02 | 634 | 434 | 68 | 29 | 56 | Poor | CE |
| 14 | 88 | 7 | 5 | 5 | 3 | 7 | 0 | — | 0.11 | 689 | 465 | 67 | 26 | 58 | Poor | CE |
| 15 | 87 | 9 | 0 | — | 3 | 0 | 13 | SC | 0.02 | 558 | 425 | 76 | 22 | 45 | Good | CE |
| 16 | 73 | 10 | 16 | 7 | 2 | 5 | 0 | B | 0.12 | 722 | 459 | 64 | 22 | 40 | Poor | CE |
| 17 | 90 | 7 | 2 | 2 | 3 | 7 | 0 | B | 0.05 | 575 | 428 | 74 | 33 | 65 | Good | CE |
| 18 | 86 | 5 | 3 | 4 | 3 | 11 | 0 | — | 0.08 | 613 | 454 | 74 | 28 | 58 | Poor | CE |
| 19 | 82 | 5 | 16 | 5 | 3 | 2 | 0 | — | 0.07 | 708 | 432 | 61 | 24 | 32 | Poor | CE |
| 20 | 83 | 5 | 16 | 6 | 3 | 1 | 0 | — | 0.08 | 696 | 431 | 62 | 25 | 33 | Poor | CE |
| 21 | 93 | 7 | 2 | 1 | 3 | 5 | 0 | — | 0.04 | 545 | 359 | 66 | 31 | 63 | Poor | CE |
| 22 | 89 | 12 | 5 | 8 | 5 | 6 | 0 | — | — | 581 | 388 | 67 | 30 | 49 | Poor | CE |
| 23 | 88 | 7 | 7 | 4 | 2 | 5 | 0 | — | 0.05 | 584 | 412 | 71 | 29 | 57 | Poor | CE |
| 24 | 83 | 5 | 3 | 3 | 3 | 3 | 11 | — | 0.04 | 721 | 542 | 75 | 23 | 39 | Poor | CE |
| 25 | 88 | 8 | 7 | 7 | 4 | 5 | 0 | — | — | 615 | 402 | 65 | 28 | 62 | Poor | CE |
| 26 | 80 | 5 | 5 | 4 | 2 | 4 | 11 | — | 0.09 | 709 | 522 | 74 | 22 | 34 | Poor | CE |
| 27 | 90 | 3 | 5 | 2 | 2 | 5 | 0 | — | 0.05 | 618 | 445 | 72 | 35 | 72 | Good | PE |
| 28 | 91 | 2 | 6 | 1 | 1 | 3 | 0 | — | 0.04 | 631 | 465 | 74 | 36 | 73 | Good | PE |
| 29 | 88 | 2 | 7 | 1 | 1 | 5 | 0 | — | 0.04 | 608 | 435 | 72 | 35 | 71 | Good | PE |
| 30 | 92 | 5 | 4 | 3 | 3 | 4 | 0 | — | 0.05 | 580 | 388 | 67 | 30 | 64 | Good | CE |
| 31 | 90 | 7 | 4 | 4 | 3 | 5 | 1 | — | 0.04 | 601 | 379 | 63 | 31 | 58 | Good | CE |
| 32 | 87 | 7 | 3 | 4 | 4 | 10 | 0 | — | 0.05 | 588 | 388 | 66 | 26 | 44 | Good | CE |

Remainder structure, B: Bainite, SC: Spherical cementite
PE: Example of the present invention;
CE: Comparative example

The invention claimed is:

1. A steel sheet of a composition comprising, in mass %, C: 0.05 to 0.11%, Si: 0.60% or less, Mn: 1.50 to 2.10%, P: 0.05% or less, S: 0.005% or less, Al: 0.01 to 0.10%, N: 0.010% or less, Ti: 0.005 to 0.07%, Nb: 0.01 to 0.10%, and the balance Fe and unavoidable impurities, and of a micro structure that contains 75 to 95% of ferrite, 5 to 15% of martensite, 0.5 to 10% of perlite, and 10% or less of unrecrystallized ferrite by volume, and a low-temperature occurring phase representing the remainder, and in which the ferrite has an average crystal grain diameter of 6 μm or less, and the martensite has an average crystal grain diameter of 3 μm or less, and an average aspect ratio of 4.0 or less, and in which a Nb base precipitate having an average grain diameter of 0.10 μm or less is contained, the steel sheet having a tensile strength of 590 MPa or more.

2. The steel sheet according to claim 1, wherein the composition further comprises, in mass %, at least one selected from Group A and B, Group A: V: 0.10% or less in mass %.

Group B: one or more selected from Cr: 0.50% or less, Mo: 0.50% or less, Cu: 0.50% or less, Ni: 0.50% or less, B: 0.01% or less, and a total of 0.005% or less of Ca and/or REM.

3. A plated steel sheet comprising a plating layer on a surface of the steel sheet of claim 1.

4. A plated steel sheet comprising a plating layer on a surface of the steel sheet of claim 2.

5. The plated steel sheet according to claim 3, wherein the plating layer is a hot-dip galvanized layer or a hot-dip galvannealed layer.

6. The plated steel sheet according to claim 4, wherein the plating layer is a hot-dip galvanized layer or a hot-dip galvannealed layer.

7. A method for producing a hot-rolled steel sheet, the method comprising:

hot rolling a steel material of the composition of claim 1 under the conditions where a rolling reduction of a final pass of finish rolling is 12% or more, a rolling reduction of a preceding pass of the final pass is 15% or more, and a finisher delivery temperature is 850 to 950° C.;

subjecting the steel after the hot rolling to primary cooling in which the steel is cooled to a cooling stop temperature at a first average cooling rate of 75° C./s or more, the cooling stop temperature being 700° C. or less;

subjecting the steel after the primary cooling to secondary cooling in which the steel is cooled to a coiling temperature at a second average cooling rate of 5° C./s or more and less than 75° C./s; and coiling the steel at a coiling temperature of 450 to 650° C.

8. A method for producing a hot-rolled steel sheet, the method comprising:

hot rolling a steel material of the composition of claim 2 under the conditions where a rolling reduction of a final pass of finish rolling is 12% or more, a rolling reduction of a preceding pass of the final pass is 15% or more, and a finisher delivery temperature is 850 to 950° C.;

subjecting the steel after the hot rolling to primary cooling in which the steel is cooled to a cooling stop temperature at a first average cooling rate of 75° C./s or more, the cooling stop temperature being 700° C. or less;

subjecting the steel after the primary cooling to secondary cooling in which the steel is cooled to a coiling temperature at a second average cooling rate of 5° C./s or more and less than 75° C./s; and coiling the steel at a coiling temperature of 450 to 650° C.

9. A method for producing a cold-rolled full-hard steel sheet, the method comprising pickling and cold rolling the hot-rolled steel sheet obtained by the method of claim 7.

10. A method for producing a cold-rolled full-hard steel sheet, the method comprising pickling and cold rolling the hot-rolled steel sheet obtained by the method of claim 8.

11. A method for producing a steel sheet, the method comprising:

heating the cold-rolled full-hard steel sheet obtained by the method of claim 9, the cold-rolled full-hard steel sheet being heated under the conditions where the dew point in a temperature range of 600° C. or more is −40° C. or less, and a maximum achieving temperature is 730 to 900° C.;

retaining the heated cold-rolled full-hard steel sheet at the maximum achieving temperature for 15 to 600 seconds; and cooling the retained cold-rolled full-hard steel sheet to a cooling stop temperature at an average cooling rate of 3 to 30° C./s, the cooling stop temperature being 600° C. or less.

12. A method for producing a steel sheet, the method comprising:

heating the cold-rolled full-hard steel sheet obtained by the method of claim 10, the cold-rolled full-hard steel sheet being heated under the conditions where the dew point in a temperature range of 600° C. or more is −40° C. or less, and a maximum achieving temperature is 730 to 900° C.;

retaining the heated cold-rolled full-hard steel sheet at the maximum achieving temperature for 15 to 600 seconds; and cooling the retained cold-rolled full-hard steel sheet to a cooling stop temperature at an average cooling rate of 3 to 30° C./s, the cooling stop temperature being 600° C. or less.

13. A method for producing a heat-treated sheet, the method comprising:

heating the cold-rolled full-hard steel sheet obtained by the method of claim 9, the cold-rolled full-hard steel sheet being heated at a heating temperature of 700 to 900° C.; and cooling the cold-rolled full-hard steel sheet.

14. A method for producing a heat-treated sheet, the method comprising:

heating the cold-rolled full-hard steel sheet obtained by the method of claim 10, the cold-rolled full-hard steel sheet being heated at a heating temperature of 700 to 900° C.; and cooling the cold-rolled full-hard steel sheet.

15. A method for producing a steel sheet, the method comprising:

heating the heat-treated sheet obtained by the method of claim 13, the heat-treated sheet being heated under the conditions where the dew point in a temperature range of 600° C. or more is −40° C. or less, and a maximum achieving temperature is 730 to 900° C.;

retaining the heat-treated sheet at the maximum achieving temperature for 15 to 600 seconds; and cooling the retained heat-treated sheet to a cooling stop temperature at an average cooling rate of 3 to 30° C./s, the cooling stop temperature being 600° C. or less.

16. A method for producing a steel sheet, the method comprising:

heating the heat-treated sheet obtained by the method of claim 14, the heat-treated sheet being heated under the conditions where the dew point in a temperature range of 600° C. or more is −40° C. or less, and a maximum achieving temperature is 730 to 900° C.;

retaining the heat-treated sheet at the maximum achieving temperature for 15 to 600 seconds; and cooling the retained heat-treated sheet to a cooling stop temperature at an average cooling rate of 3 to 30° C./s, the cooling stop temperature being 600° C. or less.

17. A method for producing a plated steel sheet, the method comprising plating a surface of the steel sheet obtained by the method of claim 11.

18. A method for producing a plated steel sheet, the method comprising plating a surface of the steel sheet obtained by the method of claim 12.

19. A method for producing a plated steel sheet, the method comprising plating a surface of the steel sheet obtained by the method of claim 15.

20. A method for producing a plated steel sheet, the method comprising plating a surface of the steel sheet obtained by the method of claim 16.

21. The method according to claim 17, wherein the plating is a process that involves hot-dip galvanization, and alloying at 450 to 600° C.

22. The method according to claim 18, wherein the plating is a process that involves hot-dip galvanization, and alloying at 450 to 600° C.

23. The method according to claim 19, wherein the plating is a process that involves hot-dip galvanization, and alloying at 450 to 600° C.

24. The method according to claim 20, wherein the plating is a process that involves hot-dip galvanization, and alloying at 450 to 600° C.

* * * * *